US012680221B2

(12) United States Patent
Anderssen et al.

(10) Patent No.: US 12,680,221 B2
(45) Date of Patent: Jul. 14, 2026

(54) LAUNDRY FUR AND DEBRIS REMOVER

(71) Applicant: Pet Parents LLC, Ankeny, IA (US)

(72) Inventors: Blake Anderssen, Ankeny, IA (US); Mikaela Sperling, Ankeny, IA (US)

(73) Assignee: Pet Parents, LLC, Ankeny, IA (US)

( * ) Notice: Subject to any disclaimer, the term of this patent is extended or adjusted under 35 U.S.C. 154(b) by 628 days.

(21) Appl. No.: 18/193,050

(22) Filed: Mar. 30, 2023

(65) Prior Publication Data

US 2023/0313439 A1 Oct. 5, 2023

Related U.S. Application Data

(60) Provisional application No. 63/362,442, filed on Apr. 4, 2022.

(51) Int. Cl.
*D06F 58/22* (2006.01)
*D06F 39/00* (2024.01)

(52) U.S. Cl.
CPC ..... *D06F 58/22* (2013.01); *D06F 39/00* (2013.01)

(58) Field of Classification Search
CPC ..... A46B 9/08; D06F 58/22; D06F 39/00
See application file for complete search history.

(56) References Cited

U.S. PATENT DOCUMENTS 3,651,530 A * 3/1972 Schultz ..... B08B 9/0552 15/104.061
4,406,031 A * 9/1983 Eimer ..... B08B 9/0552 15/104.061
5,985,042 A * 11/1999 Fiedler ..... B08B 1/165 15/244.4
D516,261 S 2/2006 Roberts
D848,096 S 5/2019 Loebach
10,531,784 B2 1/2020 Sweigart

FOREIGN PATENT DOCUMENTS

FR 2624767 A1 * 6/1989 ..... B08B 9/0552
FR 2902355 A1 * 12/2007 ..... E03F 9/002

OTHER PUBLICATIONS

FR2902355A1(machine translation) (Year: 2007).*
FR2624767A1(machine translation) (Year: 1989).*
Fur Zapper Pet Hair Remover for Laundry, https://furzapper.com/collections/all/products/furzapper-pet-hair-remover-2-pack-1-2-pet, 2 pages.

* cited by examiner

*Primary Examiner* — Andrew A Horton
(74) *Attorney, Agent, or Firm* — Robinson IP Law, PLLC

(57) ABSTRACT

Various implementations include a laundry fur remover. The laundry fur remover includes a body and one or more protrusions. The body has a body outer surface and a body maximum dimension. The one or more protrusions are coupled to and extend outwardly from the body outer surface. At least one of the one or more protrusions has a protrusion maximum dimension. At least a portion of the body or the one or more protrusions comprises a polymer. The body maximum dimension is greater than the protrusion maximum dimension.

19 Claims, 5 Drawing Sheets

Section A-A

Section B-B

LAUNDRY FUR AND DEBRIS REMOVER

FIELD

This disclosure relates to the field of pet and laundry devices. More particularly, this disclosure relates to a device for removing pet fur, hair, and general debris from various laundry textile articles such as clothing, linens, etc.

BACKGROUND

Pets, such as cats and dogs, typically shed fur or hair which may be gathered on clothing of an owner of the pet. Other pet debris may be accumulated on clothing of an owner of a pet, and removal of fur and debris may be frequently required for owners of pets. Although existing devices may allow for removal of fur, such removal may be time consuming. Further, many existing devices may be destructive to the clothing from which fur is being removed, such as by damaging fibers of the clothing while removing fur.

Some attempts have been made to provide devices and methods that remove fur while clothing is in the laundry, such as during washing or drying of the clothing. However, those products may not provide effective removal of fur during washing or drying. Existing devices may either be ineffective in removing fur from the clothing or may be destructive to articles of clothing in removing fur. Examples of existing devices include rollers and laundry balls, which have been found not to be effective in removing fur from articles of clothing. Rollers require manual removal of fur from clothing and may be destructive to articles of clothing. Laundry balls may act to impact articles of clothing within a dryer to separate the clothing but do not act to gather, remove, or otherwise cause the fur or other lint materials to be removed from the articles of clothing. Yet another example includes a disc formed of a "sticky" silicone material. However, the shapes of such devices are not well-suited for removing pet fur from various areas of the articles of clothing during laundry, can cause damage to the articles of clothing as well as getting stuck inside of the machine, and rely on the "sticky" silicone material to remove the fur, or other debris.

What is needed, therefore, is a laundry fur and debris remover that is effective in removing pet fur and other debris from articles of clothing.

SUMMARY

Various implementations include a laundry fur remover. The laundry fur remover includes a body and one or more protrusions. The body has a body outer surface and a body maximum dimension. The one or more protrusions are coupled to and extend outwardly from the body outer surface. At least one of the one or more protrusions has a protrusion maximum dimension. At least a portion of the body or the one or more protrusions includes a polymer. The body maximum dimension is greater than the protrusion maximum dimension.

In some implementations, the body is a sphere or spheroid. In some implementations, the body is a frustum of a sphere or spheroid.

In some implementations, the one or more protrusions include at least one protrusion that is a sphere or a spheroid. In some implementations, the one or more protrusions include at least one protrusion that is a frustum of a sphere or spheroid.

In some implementations, the body maximum dimension is a body maximum radius of curvature, and the protrusion maximum dimension is a protrusion maximum radius of curvature.

In some implementations, the one or more protrusions includes two or more protrusions.

In some implementations, the one or more protrusions is one or more first protrusions, and at least one of the one or more first protrusions has a first protrusion maximum dimension. In some implementations, the laundry fur remover further includes one or more second protrusions coupled to and extending outwardly from the body outer surface or from a first protrusion. In some implementations, at least one of the one or more second protrusions has a second protrusion maximum dimension. In some implementations, the first protrusion maximum dimension is greater than the second protrusion maximum dimension. In some implementations, at least a portion of the one or more second protrusions includes a polymer.

In some implementations, the polymer includes a natural rubber, a latex, or a thermoplastic rubber (TPR).

In some implementations, a surface of the body or the one or more protrusion has a Shore A hardness of from about 35 to about 65. In some implementations, the Shore A hardness is from about 40 to about 55.

In some implementations, the body includes a body wall. The body wall has the body outer surface and a body inner surface defining a body cavity.

In some implementations, the one or more protrusions include a protrusion wall. In some implementations, the protrusion wall has a protrusion outer surface and a protrusion inner surface defining a protrusion cavity.

In some implementations, the body includes a single material. In some implementations, the body and the one or more protrusions include a single material. In some implementations, the body includes two or more materials. In some implementations, the body and the one or more protrusions include two or more materials.

In some implementations, the body outer surface or a protrusion outer surface of the one or more protrusions includes a textured surface.

In some implementations, the body or the one or more protrusions include a material that is negative on the triboelectric series.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
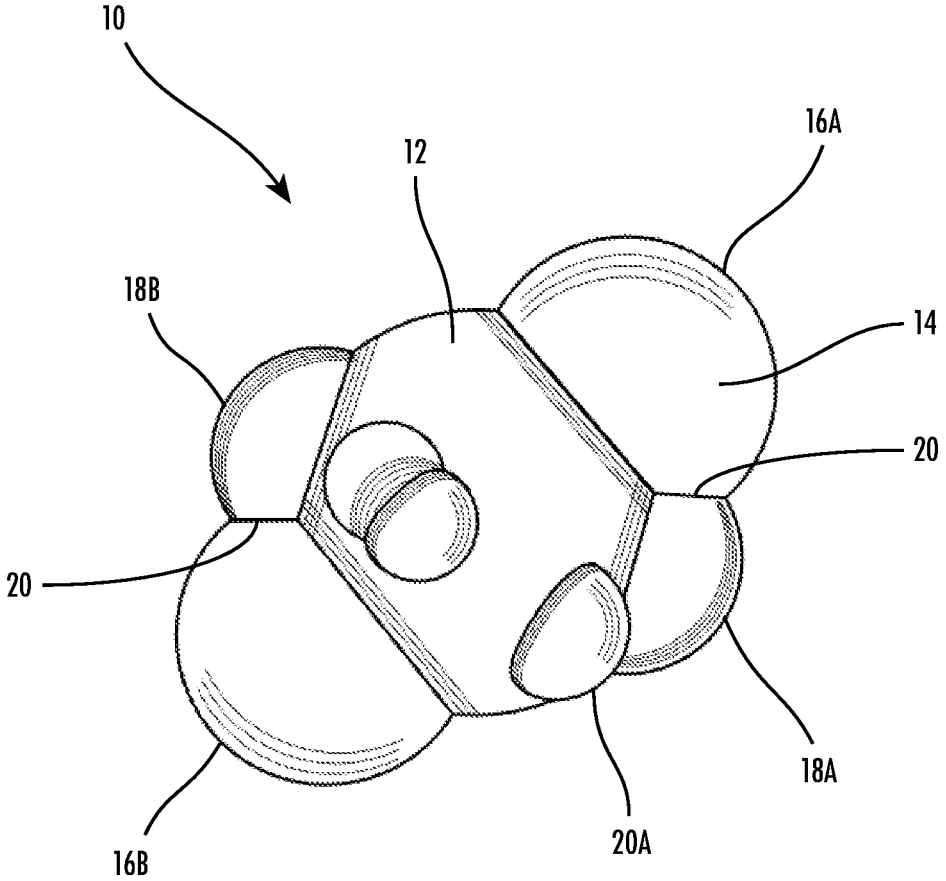
FIG. 1 shows a first side view of a laundry fur and debris remover according to one embodiment of the present disclosure.

FIG. 1 shows a basic embodiment of a laundry fur remover 10 for removing pet fur and debris from articles of clothing and other items during washing or drying of the items. The laundry fur remover 10 described herein effectively removes pet fur and debris from clothing items while the items are in a washer or dryer. A shape of the laundry fur remover 10 and materials located on outer surfaces of the laundry fur remover 10 provide effective removal of pet fur and debris from clothing items without requiring manual operation by a user and while minimizing any potential destruction of the clothing items. The laundry fur remover 10 may be suitable for use in a washing machine or dryer and may remove pet fur and debris from items in the washing machine or dryer during a washing or drying cycle.

The laundry fur remover 10 includes a body 12. The body 12 may have a rounded shape, such as a sphere or spheroid/oblate spheroid shape or other similar shapes that do not feature any sharp protruding angles or surfaces. Although the figures illustrate a sphere or spheroid shape for the body portion, it is also understood that a shape of the body portion 12 may vary. For example, the body 12 may be other polygonal shapes, and those other polygonal shapes may include rounded or smoothed edges to prevent damage to articles during cleaning with the laundry fur remover 10 as described herein.

The body 12 may be located at or towards a center of the laundry fur remover 10. The body 12 is shaped such that the body 12 has a width, diameter, or other dimensions that are greater than other portions of the laundry fur remover 10, as shown in the figures. For example, when the body 12 is spherical or a spheroid shape, a diameter of the body 12 may be greater than other portions of the laundry fur remover 10 that are joined to the body 12 as described in greater detail below. One or more sides of the body 12 may be truncated or frustum shaped, such as where other portions of the laundry fur remover 10 are joined with the body 12 as shown in the figures and described in greater detail below.

The laundry fur remover 10 further includes a plurality of surface protrusions 14 arranged on the body 12. The surface protrusions 14 may be arranged around and project from the body 12 of the laundry fur remover 10. As shown in the figures, the surface protrusions 14 may be at least partially spherical or spheroid in shape and may be joined to the body 12 such that the surface protrusions 14 extend away from an outer surface of the body 12. Although the surface protrusions 14 are shown in the figures as being spherical or spheroid in shape, a shape of the surface protrusions 14 may vary. For example, the surface protrusions 14 may be formed in various other shapes, such as various polygonal shapes. The surface protrusions 14 may include a smooth outer surface without any sharp edges to prevent damage to articles contacting the laundry fur remover during washing or drying of the articles. The surface protrusions 14 may be at least partially truncated or frustum shaped, such as where the surface protrusions 14 join with an outer surface of the body 12.

The surface protrusions 14 may further vary in size relative to the body 12 of the laundry fur remover 10. The body 12 may be larger than the surface protrusions 14. Further, the surface protrusions 14 may vary in size relative to other of the surface protrusions 14 such that the surface protrusions 14 may contact multiple areas to remove fur from various areas of articles being cleaned during washing or drying of the articles. In some implementations, such as those shown in the figures, the body has a body maximum dimension, the one or more protrusions has a protrusion maximum dimension, and the body maximum dimension is greater than the protrusion maximum dimension. In some implementations, the body maximum dimension is a body maximum radius of curvature, and the protrusion maximum dimension is a protrusion maximum radius of curvature. In some implementations, the body maximum dimension is a body maximum diameter, and the protrusion maximum dimension is a protrusion maximum diameter.

Figure 2:
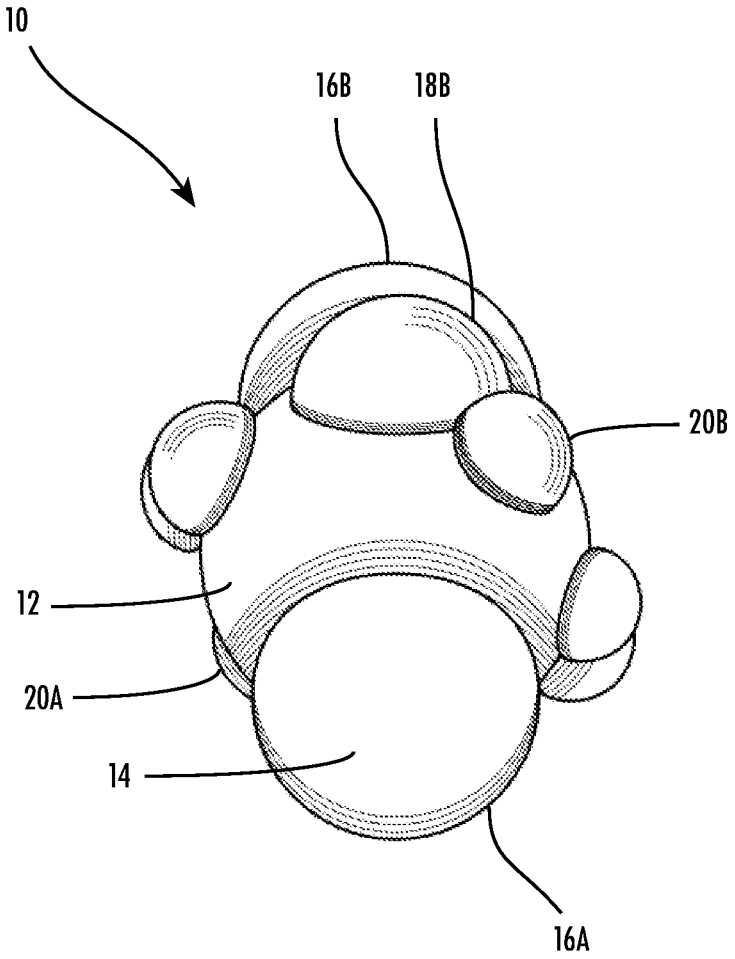
FIG. 2 shows a first end view of a laundry fur and debris remover according to one embodiment of the present disclosure.
Figure 3:
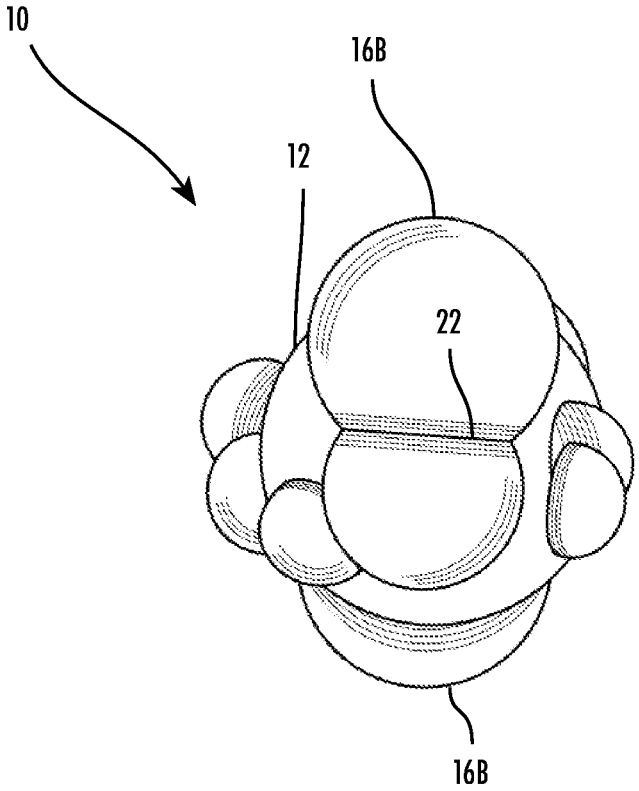
FIG. 3 shows a second end view of a laundry fur and debris remove according to one embodiment of the present disclosure.

The surface protrusions 14 may vary in size around the body 12 of the laundry fur remover 10. As shown in FIG. 2, the laundry fur remover 10 may include one or more first protrusions 16A and 16B. The first protrusions 16A and 16B may be located, for example, on ends of the body 12 of the laundry fur remover 10. The first protrusions 16A and 16B may be smaller in size than the body 12 of the laundry fur remover 10, as shown in the figures. The laundry fur remover 10 may further include one or more second protrusions 18A and 18B. The second protrusions 18A and 18B may be smaller in size than the one or more first protrusions 16A and 16B. The one or more second protrusions 18A and 18B may be located around the body 12 of the laundry fur remover 10, such as around sides of the body 12. The laundry fur remover 10 may further include one or more third protrusions 20A and 20B. The one or more third protrusions 20A and 20B may be smaller in size than the one or more second protrusions 18A and 18B and may similarly be located around the body 12 of the laundry fur remover 10. A number of and locations of protrusions located around the body 12 of the laundry fur remover 10 may vary, such as additional or fewer protrusions located around various portions of the body 12.

The protrusions 14 may be located around a surface of the body 12 of the laundry fur remover 10. One or more of the protrusions 14 may abut one another on the laundry fur remover to define an intersecting portion 22 between the protrusions or between the protrusions 14 and the body 12. Arrangement of the protrusions 14 around the body 12 of the laundry fur remover 10 may be substantially symmetrical or asymmetrical.

Figure 4:
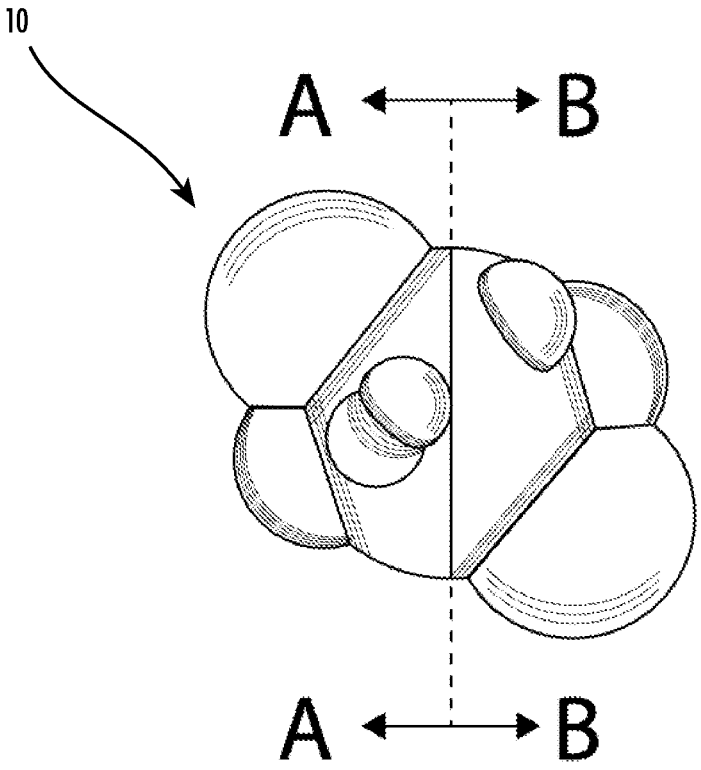
FIG. 4 shows a second side view of a laundry fur and debris remover according to one embodiment of the present disclosure.
Figure 5:
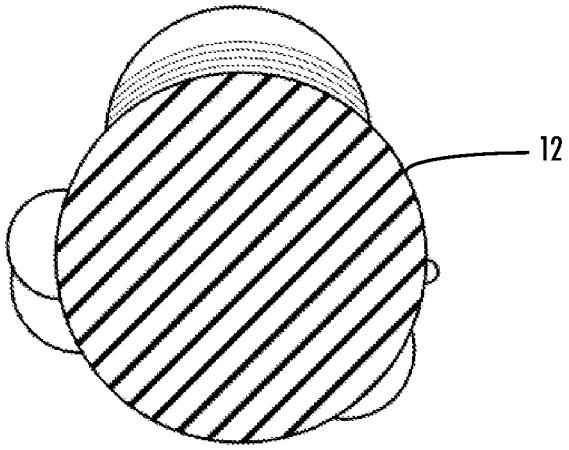
FIG. 5 is a first cross-sectional view of a laundry fur and debris remover according to one embodiment of the present disclosure.
Figure 6:
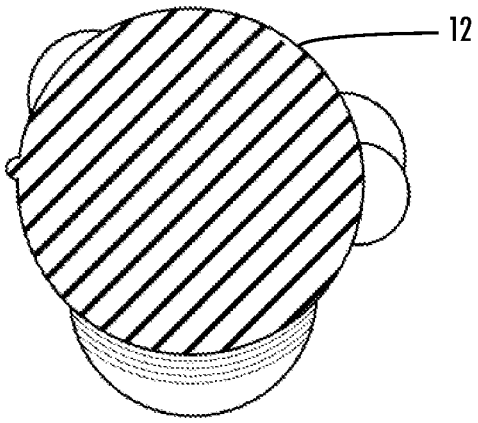
FIG. 6 is a second cross-sectional view of a laundry fur and debris remover according to one embodiment of the present disclosure.

Referring to FIGS. 4-6, the body 12 of the laundry fur remover 10 is substantially solid or may feature a hollow interior. For implementations in which the body and/or protrusions of the laundry fur remover are hollow, the body and/or protrusions include a wall. The wall has an outer surface and an inner surface defining a cavity.

The body 12 and the protrusions 14 may be formed of a polymer, such as a rubber or a resilient elastic material. Suitable materials may include, for example, natural rubber, latex, or thermoplastic rubber (TPR). A surface of the body 12 and the protrusion may have a hardness such that the laundry fur remover 10 may substantially remove fur from articles of clothing or other items in a washing machine or dryer. For example, a hardness of an outer surface of the body 12 and the protrusions 14 of the laundry fur remover may have a Shore A hardness ranging from about 35 to about 65. But, in some implementations, the hardness of the outer surface of the body 12 and the protrusions 14 of the laundry fur remover may have a Shore A hardness ranging from about 40 to about 55. For example, in some implementations, the hardness of the outer surface of the body 12 and the protrusions 14 of the laundry fur remover may have a Shore A hardness of about 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, or 65.

The laundry fur remover 10 may be consistently formed of the same, single material as on the surface of the laundry fur remover 10 through a center of the laundry fur remover 10. Alternatively, the laundry fur remover 10 may be formed of a first material forming an interior of the laundry fur remover 10 and a second material located as a coating over the first material. The body 12 of the laundry fur remover 10 may be formed of a first material and the protrusions may be formed of a second material that is different from the first material. Further, the protrusions 14 may be formed of a single material or two or more materials.

A surface material of the body 12 and the protrusions 14 preferably produces positive ions to neutralize potential static charges built up during cleaning that would ordinarily cause articles of clothing or other items to stick together and for causing fur or debris to remain stuck to articles of clothing or other items. This reduces the amount that clothing items stick to one another or that fur or debris sticks to the clothing items, further enhancing the removal of fur or debris from those items. In some implementations, the laundry fur remover includes a material that is negative on the triboelectric series. In some implementations, the laundry fur remover includes an electrically insulative material. In some implementations, the laundry fur remover includes a material that dissipates electrical charge.

Surfaces of the body 12 and the protrusions 14 may also be textured and having a reduced shine or slickness. Textured surface further enable the laundry fur remover 10 to grip fur and other debris to remove the fur and debris from clothing and other items during cleaning of the clothing or other items, with a reduced risk of causing any damage.

The laundry fur remover 10 advantageously enhances removal of fur and other debris from articles of clothing and other items. The body 12, protrusions 14, and intersecting portions 22 provide enhanced surface areas of the laundry fur remover 10 that contact articles of clothing or other items to remove fur and debris from those items. Various sized protrusions 14 of the laundry fur remover create different effects on clothing or other items. For example, the larger body 12 or larger of the protrusions 14 may impart a "beating" effect on articles of clothing or other items. Smaller of the protrusions 14 may induce more of a "scrubbing" effect on articles of clothing or other items within a washing machine or dryer. Further, surfaces of the laundry fur remover 10 act to grip fur and debris located on the clothing items and remove the fur or debris from the items. Finally, the laundry fur remover 10 is shaped such that the laundry fur remover 10 may impact articles of clothing and other items during a wash or dry cycle in a washing machine or dryer to shake fur and other debris loose from the articles of clothing.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A laundry fur remover comprising:

a body having a body outer surface, wherein the body has a body maximum dimension; and one or more protrusions coupled to and extending outwardly from the body outer surface, wherein at least one of the one or more protrusions has a protrusion maximum dimension, wherein at least a portion of the body or the one or more protrusions comprises a polymer, wherein the body maximum dimension is greater than the protrusion maximum dimension, and wherein the body is a frustum of a sphere or spheroid.

2. The laundry fur remover of claim 1, wherein the body is a sphere or spheroid.

3. The laundry fur remover of claim 1, wherein the one or more protrusions include at least one protrusion that is a sphere or a spheroid.

4. The laundry fur remover of claim 1, wherein the body maximum dimension is a body maximum radius of curvature, and the protrusion maximum dimension is a protrusion maximum radius of curvature.

5. The laundry fur remover of claim 1, wherein the one or more protrusions includes two or more protrusions.

6. The laundry fur remover of claim 1, wherein the one or more protrusions is one or more first protrusions and at least one of the one or more first protrusions has a first protrusion maximum dimension, the laundry fur remover further comprising one or more second protrusions coupled to and extending outwardly from the body outer surface or from a first protrusion, wherein at least one of the one or more second protrusions has a second protrusion maximum dimension, wherein the first protrusion maximum dimension is greater than the second protrusion maximum dimension.

7. The laundry fur remover of claim 6, wherein at least a portion of the one or more second protrusions comprises a polymer.

8. The laundry fur remover of claim 1, wherein the polymer comprises a natural rubber, a latex, or a thermoplastic rubber (TPR).

9. The laundry fur remover of claim 1, wherein a surface of the body or the one or more protrusion has a Shore A hardness of from about 35 to about 65.

10. The laundry fur remover of claim 9, wherein the Shore A hardness is from about 40 to about 55.

11. The laundry fur remover of claim 1, wherein the body comprises a body wall, wherein the body wall has the body outer surface and a body inner surface defining a body cavity.

12. The laundry fur remover of claim 1, wherein the one or more protrusions comprise a protrusion wall, wherein the protrusion wall has a protrusion outer surface and a protrusion inner surface defining a protrusion cavity.

13. The laundry fur remover of claim 1, wherein the body comprises a single material.

14. The laundry fur remover of claim 13, wherein the body and the one or more protrusions comprise a single material.

15. The laundry fur remover of claim 1, wherein the body comprises two or more materials.

16. The laundry fur remover of claim 15, wherein the body and the one or more protrusions comprise two or more materials.

17. The laundry fur remover of claim 1, wherein the body outer surface or a protrusion outer surface of the one or more protrusions comprises a textured surface.

18. The laundry fur remover of claim 1, wherein the body or the one or more protrusions comprise a material that is negative on the triboelectric series.

19. A laundry fur remover comprising:

a body having a body outer surface, wherein the body has a body maximum dimension; and one or more protrusions coupled to and extending outwardly from the body outer surface, wherein at least one of the one or more protrusions has a protrusion maximum dimension, wherein at least a portion of the body or the one or more protrusions comprises a polymer, wherein the body maximum dimension is greater than the protrusion maximum dimension, and wherein the one or more protrusions include at least one protrusion that is a frustum of a sphere or spheroid.

* * * * *